US009013386B2

(12) United States Patent
Tsai et al.

(10) Patent No.: US 9,013,386 B2
(45) Date of Patent: Apr. 21, 2015

(54) LIQUID CRYSTAL DISPLAY AND METHOD FOR OPERATING THE SAME

(75) Inventors: Cheng-Che Tsai, Tainan (TW); Yu-Chu Yang, Tainan (TW); Pu-Jen Cheng, Tainan (TW)

(73) Assignee: Himax Technologies Limited, Tainan (TW)

( * ) Notice: Subject to any disclaimer, the term of this patent is extended or adjusted under 35 U.S.C. 154(b) by 616 days.

(21) Appl. No.: 13/346,427

(22) Filed: Jan. 9, 2012

(65) Prior Publication Data

US 2013/0176348 A1 Jul. 11, 2013

(51) Int. Cl.
*G09G 3/36* (2006.01)

(52) U.S. Cl.
CPC ..... *G09G 3/3648* (2013.01); *G09G 3/3614* (2013.01); *G09G 3/3696* (2013.01); *G09G 2310/067* (2013.01); *G09G 2310/08* (2013.01); *G09G 2320/0204* (2013.01); *G09G 2320/0247* (2013.01); *G09G 2320/0261* (2013.01); *G09G 2320/0276* (2013.01); *G09G 2320/041* (2013.01); *G09G 2320/0673* (2013.01); *G09G 2320/103* (2013.01); *G09G 2340/0435* (2013.01)

(58) Field of Classification Search
CPC . G09G 3/3648; G09G 3/3614; G09G 3/3688; G09G 2330/027; G09G 2330/0673; G09G 2330/103; G09G 2340/0435
USPC ..... 345/87–100, 204, 690
See application file for complete search history.

(56) References Cited

U.S. PATENT DOCUMENTS

| | | | | |
|---|---|---|---|---|
| 2005/0285837 | A1* | 12/2005 | Akimoto | 345/96 |
| 2007/0097059 | A1* | 5/2007 | Tanaka | 345/98 |
| 2011/0115779 | A1* | 5/2011 | Fujikawa | 345/212 |

FOREIGN PATENT DOCUMENTS

| | | | |
|---|---|---|---|
| JP | 2002-082659 | * | 3/2002 |
| TW | 444184 | | 7/2001 |
| TW | 200401253 | | 1/2004 |
| TW | I258724 | | 7/2006 |
| TW | 201133456 | | 10/2011 |

OTHER PUBLICATIONS

"Office Action of Taiwan Counterpart Application", issued on Jun. 17, 2014, p. 1-p. 6.

* cited by examiner

*Primary Examiner* — Jennifer Nguyen
(74) *Attorney, Agent, or Firm* — J.C. Patents

(57) ABSTRACT

A liquid crystal display (LCD) and an operating method thereof are provided. The operating method includes the following steps. It is determined whether a first frame and a second frame following the first frame are dynamic frames. When the first frame and the second frame are dynamic frames, a timing controller of the LCD performs a polarity inversion on a polarity signal, so that the polarity signal corresponding to the first frame is the same as the polarity signal corresponding to the second frame. When the second frame is written into an LCD panel of the LCD, energy written into the LCD panel is reduced.

24 Claims, 4 Drawing Sheets

LIQUID CRYSTAL DISPLAY AND METHOD FOR OPERATING THE SAME

BACKGROUND OF THE INVENTION

1. Field of the Invention

The invention relates to a display and a method for operating the same. Particularly, the invention relates to a liquid crystal display and a method for operating the same.

2. Description of Related Art

Along with quick development of photoelectric technology and semiconductor techn39712ology, flat panel displays such as liquid crystal displays (LCDs) are quickly developed in recent years. Since the LCD has advantages of low power consumption, no irradiation and high spatial usage rate, etc., it becomes a main stream in today's flat panel display market. Since an LCD panel does not emit light itself, a backlight module has to be configured at the back of the LCD panel for providing a planar light source required by the LCD panel. The LCD panel controls a rotation angle of liquid crystal to adjust light transmittance and reflectivity of the light source, so as to display images.

Generally, the rotation angle of the liquid crystal is determined by a voltage difference of two ends of the liquid crystal layer and a direction of an electric field. In order to avoid a liquid crystal polarization phenomenon, the LCD generally applies a driving method of polarity inversion, i.e. voltages of different polarities (for example, a positive polarity and a negative polarity) are used to alternatively drive the liquid crystal at different time. The polarity of the voltage applied on the liquid crystal is determined by the direction of the electric field applied on the liquid crystal. Assuming a voltage of a pixel electrode is greater than a common voltage, the liquid crystal is driven by the voltage of the positive polarity. Conversely, the liquid crystal is driven by the voltage of the negative polarity.

However, when the LCD panel displays dynamic frames, a gray value displayed by each pixel on the LCD panel is probably varied constantly. In case of gray value variation, the liquid crystal of the LCD panel may have the polarization phenomenon, i.e. the liquid crystal in the pixels may have remained DC voltages, which may cause motion blur of the LCD panel.

SUMMARY OF THE INVENTION

The invention is directed to a liquid crystal display (LCD) and a method for operating the same, in which a polarity signal inversion is performed to reduce a chance of generating motion blur on an LCD panel. Moreover, a frame flicking phenomenon caused by polarity signal inversion is suppressed.

The invention provides a method for operating a liquid crystal display (LCD), which includes the following steps. It is determined whether a first frame and a second frame following the first frame are dynamic frames. When the first frame and the second frame are the dynamic frames, a timing controller of the LCD performs a polarity inversion on a polarity signal to equalize the polarity signal corresponding to the first frame with the polarity signal corresponding to the second frame. When the second frame is written into an LCD panel of the LCD, energy written into the LCD panel is reduced.

In an embodiment of the invention, the step of reducing the energy written into the LCD panel includes shortening a pulse width of an output enable signal or a gate clock signal to shorten pulse widths of a plurality of scan signals output to the LCD panel.

In an embodiment of the invention, the method for operating the LCD further includes following steps. When a frame rate of the LCD is decreased to be smaller than a first frame rate threshold, the pulse width of the output enable signal or the gate clock signal is set to a first pulse width. When the frame rate of the LCD is increased to be greater than a second frame rate threshold, the pulse width of the output enable signal or the gate clock signal is set to a second pulse width, where the first frame rate threshold is greater than the second frame rate threshold, and the first pulse width is greater than the second pulse width.

In an embodiment of the invention, the method for operating the LCD further includes following steps. When a working temperature of the LCD is decreased to be smaller than a first temperature threshold, the pulse width of the output enable signal or the gate clock signal is set to a third pulse width. When the working temperature of the LCD is increased to be greater than a second temperature threshold, the pulse width of the output enable signal or the gate clock signal is set to a fourth pulse width, where the first temperature threshold is greater than the second temperature threshold, and the third pulse width is greater than the fourth pulse width.

In an embodiment of the invention, the step of reducing the energy written into the LCD panel includes delaying a latch signal to shorten output time of a plurality of pixel voltages output to the LCD panel.

In an embodiment of the invention, the method for operating the LCD further includes following steps. When a frame rate of the LCD is decreased to be smaller than a first frame rate threshold, a delay time of the latch signal is set to a first delay time. When the frame rate of the LCD is increased to be greater than a second frame rate threshold, the delay time of the latch signal is set to a second delay time, where the first frame rate threshold is greater than the second frame rate threshold, and the first delay time is greater than the second delay time.

In an embodiment of the invention, the method for operating the LCD further includes following steps. When a working temperature of the LCD is decreased to be smaller than a first temperature threshold, a delay time of the latch signal is set to a third delay time. When the working temperature of the LCD is increased to be greater than a second temperature threshold, the delay time of the latch signal is set to a fourth delay time, where the first temperature threshold is greater than the second temperature threshold, and the third delay time is smaller than the fourth delay time.

In an embodiment of the invention, the step of reducing the energy written into the LCD panel includes reducing gray values corresponding to a plurality of pixel voltages output to the LCD panel.

In an embodiment of the invention, the method for operating the LCD further includes following steps. When a frame rate of the LCD is decreased to be smaller than a first frame rate threshold, the gray values corresponding to the pixel voltages are decreased by a first gray value. When the frame rate of the LCD is increased to be greater than a second frame rate threshold, the gray values corresponding to the pixel voltages are decreased by a second gray value, where the first frame rate threshold is greater than the second frame rate threshold, and the first gray value is greater than the second gray value.

In an embodiment of the invention, the method for operating the LCD further includes following steps. When a working temperature of the LCD is decreased to be smaller than a first temperature threshold, the gray values corresponding to the pixel voltages are decreased by a third gray value. When the working temperature of the LCD is increased to be greater than a second temperature threshold, the gray values corresponding to the pixel voltages are decreased by a fourth gray value, where the first temperature threshold is greater than the second temperature threshold, and the third gray value is smaller than the fourth gray value.

In an embodiment of the invention, the method for operating the LCD further includes stopping performing the polarity inversion on the polarity signal when one of the first frame and the second frame is a static frame.

In an embodiment of the invention, the step of determining whether the first frame is the dynamic frame includes following steps. When the first frame and a plurality of consecutive previous frames are different, it is determined that the first frame is the dynamic frame. When two neighbouring frames of the first frame and the previous frames are the same, it is determined that the first frame is a static frame, where the first frame follows the previous frames.

The invention also provides a liquid crystal display (LCD) including an LCD panel, a gate driver, a source driver and a timing controller. The gate driver is coupled to the LCD panel for outputting a plurality of scan signals to the LCD panel. The source driver is coupled to the LCD panel for outputting a plurality of pixel voltages to the LCD panel. The timing controller is coupled to the gate driver and the source driver for receiving a first frame and a second frame following the first frame, and determining whether the first frame and the second frame are dynamic frames. When the first frame and the second frame are the dynamic frames, the timing controller performs a polarity inversion on a polarity signal output to the source driver to equalize the polarity signal corresponding to the first frame with the polarity signal corresponding to the second frame. When the second frame is written into the LCD panel, the timing controller adjusts output states of the scan signals or the pixel voltages to reduce energy written into the LCD panel.

In an embodiment of the invention, the timing controller shortens a pulse width of an output enable signal or a gate clock signal output to the gate driver to shorten pulse widths of the scan signals output to the LCD panel.

In an embodiment of the invention, when a frame rate of the LCD is decreased to be smaller than a first frame rate threshold, the timing controller sets the pulse width of the output enable signal or the gate clock signal to a first pulse width. When the frame rate of the LCD is increased to be greater than a second frame rate threshold, the timing controller sets the pulse width of the output enable signal or the gate clock signal to a second pulse width, where the first frame rate threshold is greater than the second frame rate threshold, and the first pulse width is greater than the second pulse width.

In an embodiment of the invention, when a working temperature of the LCD is decreased to be smaller than a first temperature threshold, the timing controller sets the pulse width of the output enable signal or the gate clock signal to a third pulse width. When the working temperature of the LCD is increased to be greater than a second temperature threshold, the timing controller sets the pulse width of the output enable signal or the gate clock signal to a fourth pulse width, where the first temperature threshold is greater than the second temperature threshold, and the third pulse width is greater than the fourth pulse width.

In an embodiment of the invention, the timing controller delays a latch signal output to the source driver to shorten output time of the pixel voltages output to the LCD panel.

In an embodiment of the invention, when a frame rate of the LCD is decreased to be smaller than a first frame rate threshold, the timing controller sets a delay time of the latch signal to a first delay time. When the frame rate of the LCD is increased to be greater than a second frame rate threshold, the timing controller sets the delay time of the latch signal to a second delay time, where the first frame rate threshold is greater than the second frame rate threshold, and the first delay time is greater than the second delay time.

In an embodiment of the invention, when a working temperature of the LCD is decreased to be smaller than a first temperature threshold, the timing controller sets a delay time of the latch signal to a third delay time. When the working temperature of the LCD is increased to be greater than a second temperature threshold, the timing controller sets the delay time of the latch signal to a fourth delay time, where the first temperature threshold is greater than the second temperature threshold, and the third delay time is smaller than the fourth delay time.

In an embodiment of the invention, the timing controller controls the source driver to reduce gray values corresponding to a plurality of pixel voltages output to the LCD panel.

In an embodiment of the invention, when a frame rate of the LCD is decreased to be smaller than a first frame rate threshold, the timing controller controls the source driver to decrease the gray values corresponding to the pixel voltages by a first gray value. When the frame rate of the LCD is increased to be greater than a second frame rate threshold, the timing controller controls the source driver to decrease the gray values corresponding to the pixel voltages by a second gray value, where the first frame rate threshold is greater than the second frame rate threshold, and the first gray value is greater than the second gray value.

In an embodiment of the invention, when a working temperature of the LCD is decreased to be smaller than a first temperature threshold, the timing controller controls the source driver to decrease the gray values corresponding to the pixel voltages by a third gray value. When the working temperature of the LCD is increased to be greater than a second temperature threshold, the timing controller controls the source driver to decrease the gray values corresponding to the pixel voltages by a fourth gray value, where the first temperature threshold is greater than the second temperature threshold, and the third gray value is smaller than the fourth gray value.

In an embodiment of the invention, when one of the first frame and the second frame is a static frame, the timing controller stops performing the polarity inversion on the polarity signal.

In an embodiment of the invention, when the first frame and a plurality of consecutive previous frames are different, the timing controller determines the first frame to be the dynamic frame. When two neighbouring frames of the first frame and the previous frames are the same, the timing controller determines the first frame to be a static frame, where the first frame follows the previous frames.

According to the above descriptions, in the LCD and the method for operating the same, when the first frame and the second frame are all dynamic frames, the timing controller performs the polarity inversion on the polarity signal to equalize the polarity signal corresponding to the first frame with the polarity signal corresponding to the second frame, so as to suppress polarization of liquid crystal of the LCD panel. Moreover, the timing controller adjusts the scan signals or the pixel voltages to reduce the energy of the second frame written into the LCD panel, and avoid a frame flicking phenomenon occurred when the LCD panel displays the brighter second frame.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
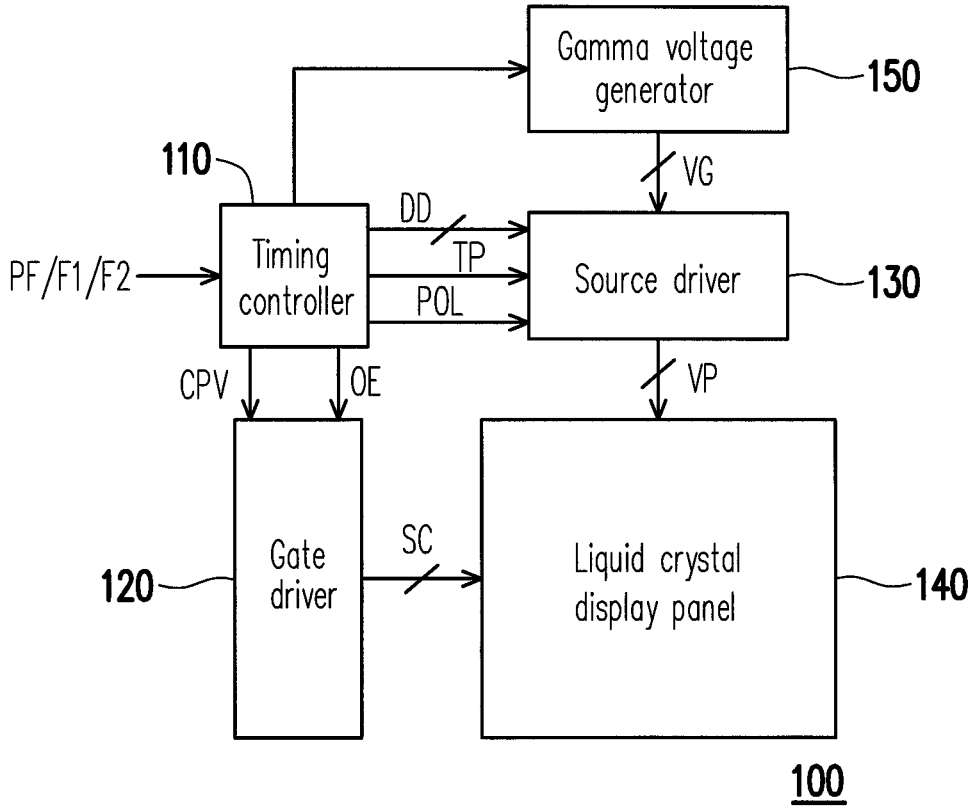
FIG. 1 is a system schematic diagram of a liquid crystal display (LCD) according to an embodiment of the invention.

FIG. 1 is a system schematic diagram of a liquid crystal display (LCD) according to an embodiment of the invention. Referring to FIG. 1, in the present embodiment, the LCD 100 includes a timing controller 110, a gate driver 120, a source driver 130, an LCD panel 140 and gamma voltage generator 150. The timing controller 110 is coupled to the gate driver 120, the source driver 130 and the gamma voltage generator 150, and the gate driver 120 and the source driver 130 are respectively coupled to the LCD panel 140. The gamma voltage generator 150 is used for generating a plurality of gamma voltages VG to the source driver 130.

The timing controller 110 sequentially receives a plurality of consecutive previous frames PF, a first frame F1 and a second frame F2, and outputs a plurality of display data DD, a latch signal TP and a polarity signal POL to the source driver 130 according to the previous frames PF, the first frame F1 and the second frame F2, so as to control the source driver 130 to output a plurality of pixel voltages VP to the LCD panel 140 according to the received gamma voltages VG. Moreover, the timing controller 110 outputs a gate clock signal CPV and an output enable signal OE to the gate driver 120 for controlling the gate driver 120 to output a plurality of scan signals SC to the LCD panel 140. The LCD panel 140 is driven by the scan signals SC to receive the pixel voltages VP, and displays images corresponding to the previous frames PF, the first frame F1 or the second frame F2.

Moreover, the timing controller 110 determines whether the first frame F1 and the second frame F2 are dynamic frames. When the first frame F1 and the second frame F2 are all dynamic frames, the timing controller 110 can perform a polarity inversion on the polarity signal POL to equalize the polarity signal POL corresponding to the first frame F1 with the polarity signal POL corresponding to the second frame F2, so as to reduce a chance that liquid crystal of the LCD panel 140 is polarized when the LCD panel 140 displays dynamic images. Conversely, when one of the first frame F1 and the second frame F2 is determined to be a static frame, the timing controller 110 stops performing the polarity inversion on the polarity signal POL.

In case that the polarity signal POL corresponding to the first frame F1 is the same to the polarity signal POL corresponding to the second frame F2, each of pixels (not shown) of the LCD panel 140 has a same polarity charging phenomenon, i.e. polarities of the pixel voltage VP corresponding to each of the pixels in the first frame F1 and the second frame F2 are the same. In case of the same polarity charging, the second frame F2 displayed by the LCD panel 140 is brighter, which may cause a frame flicking phenomenon. Therefore, when the second frame F2 is written into the LCD panel 140, the timing controller 110 adjusts output states of the scan signals SC or the pixel voltages VP to reduce energy written into the LCD panel 140, so as to avoid the frame flicking phenomenon occurred when the LCD panel 140 displays the brighter second frame F2.

In the present embodiment, the gamma voltage generator 150 is controlled by the timing controller 110 to generate the gamma voltages VG. However, in other embodiments, the gamma voltage generator 150 can independently operate to generate the gamma voltages VG, and the invention is not limited thereto, i.e. the gamma voltage generator 150 is not necessarily coupled to the timing controller 110.

Figure 2:
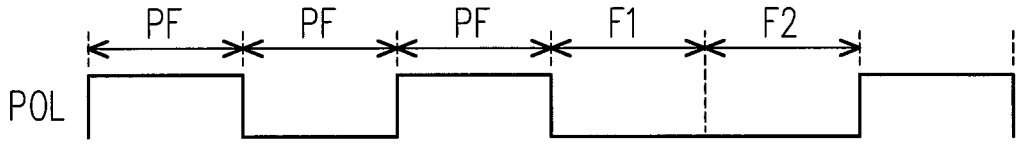
FIG. 2 is a timing schematic diagram of a polarity signal of FIG. 1 according to an embodiment of the invention.

FIG. 2 is a timing schematic diagram of the polarity signal of FIG. 1 according to an embodiment of the invention. Referring to FIG. 1 and FIG. 2, in the present embodiment, the timing controller 110 can determine whether the first frame F1 is a dynamic frame according to the previous frames PF and the first frame F1. Further, when the previous frames PF and the first frame F1 are different, the timing controller 110 determines the first frame F1 to be the dynamic frame. Conversely, when two neighbouring frames of the first frame F1 and the previous frames PF are the same, the timing controller 110 determines the first frame F1 to be a static frame. In other words, when the timing controller 110 counts that N consecutive frames are different frames, it determines an Nth frame to be the dynamic frame. Conversely, the timing controller 110 determines the Nth frame to be the static frame, where N is a positive integer.

Similarly, whether the second frame F2 is a dynamic frame can be determined according to the previous frames PF and the first frame F1. Moreover, in case that the first frame F1 and the second frame F2 are all dynamic frames, the timing controller 110 performs the polarity inversion on the polarity signal POL of the second frame F2 to equalize the polarity signal POL corresponding to the first frame F1 and the polarity signal POL corresponding to the second frame F2. In other words, when the timing controller 110 counts that the N consecutive frames are different frames, and an (N+1)th frame (corresponding to the second frame F2) is also different to the Nth frame (corresponding to the first frame F1), the timing controller 110 performs the polarity inversion on the polarity signal POL of the (N+1)th frame. Conversely, the timing controller 110 does not perform the polarity inversion on the polarity signal POL of the (N+1)th frame.

Figure 3A:
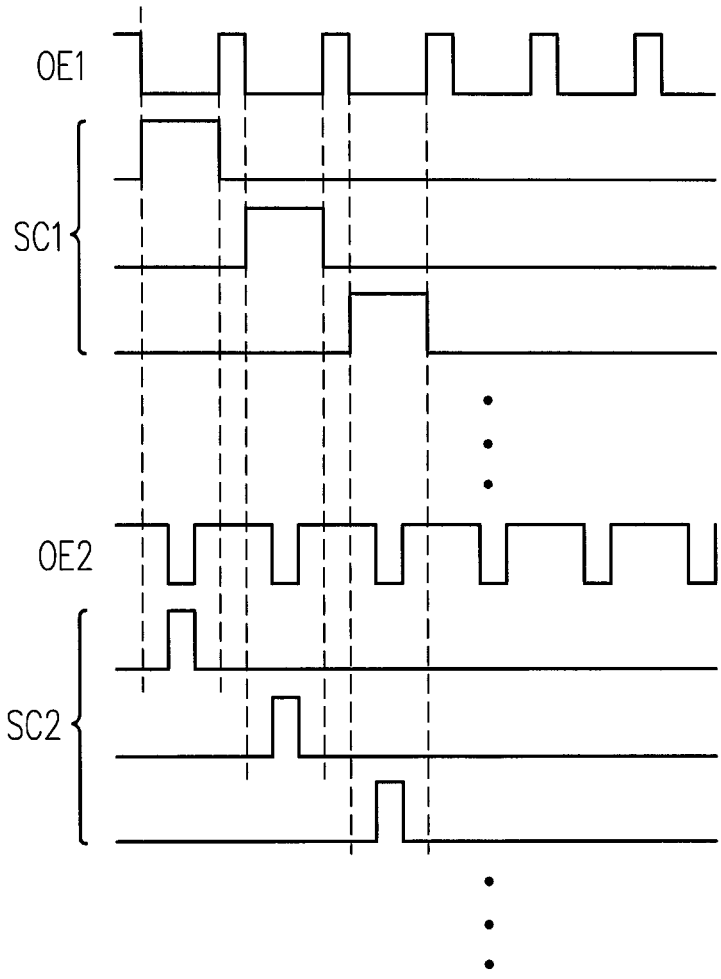
FIG. 3A is a timing schematic diagram of output enable signals and scan signals of FIG. 1 according to an embodiment of the invention.

FIG. 3A is a timing schematic diagram of output enable signals and scan signals of FIG. 1 according to an embodiment of the invention. Referring to FIG. 1 and FIG. 3A, in the present embodiment, an output enable signal OE1 and a scan signals SC1 correspond to the first frame F1, and an output enable signal OE2 and a scan signals SC2 correspond to the second frame F2. According to the above descriptions, when the timing controller 110 performs the polarity inversion on the polarity signal POL of the second frame F2, the timing controller 110 adjusts the output states of the scan signals SC or the pixel voltages VP to reduce energy written into the LCD panel 140.

In the present embodiment, a first method of reducing the energy written into the LCD panel 140 is to shorten pulse widths of the scan signals SC. Since the pulse widths of the scan signals SC determine a time for each of the pixels (not shown) of the LCD panel 140 receiving the pixel voltages VP, the pulse widths of the scan signals SC can determine a magnitude of energy received by the LCD panel 140, i.e. the energy written into the LCD panel 140 can be reduced by shortening the pulse widths of the scan signals SC.

In the present embodiment, it is assumed that the pulse widths of the scan signals SC are controlled by pulse width of the output enable signal OE, as the pulse width of the output enable signal OE2 output by the timing controller 110 in the second frame F2 is smaller than the pulse width of the output enable signal OE1 output in the first frame F1, the pulse widths of the scan signals SC2 output by the gate driver 120 in the second frame F2 is smaller than the pulse widths of the scan signals SC1 output in the first frame F1, for example, the pulse widths of the scan signals SC2 is 0.3 times of the pulse widths of the scan signals SC1. The pulse widths of the scan signal SC2 can be determined according to a frame brightness difference of the first frame F1 and the second frame F2, i.e. the greater the frame brightness difference is, the narrower the pulse width of each scan signal SC2 is, and the smaller the frame brightness difference is, the wider the pulse width of each scan signal SC2 is.

In another embodiment, the pulse widths of the scan signals SC can be controlled by a pulse width of the gate clock signal CPV, so that as the pulse width of the gate clock signal CPV output by the timing controller 110 in the second frame F2 is smaller than the pulse width of the gate clock signal CPV output in the first frame F1, the pulse widths of the scan signals SC2 output by the gate driver 120 in the second frame F2 is smaller than the pulse widths of the scan signals SC1 output in the first frame F1.

In another embodiment, the pulse widths of the scan signals SC can be simultaneously controlled by the pulse width of the output enable signal OE and the gate clock signal CPV, so that the pulse widths of the output enable signal OE2 and the gate clock signal CPV output by the timing controller 110 in the second frame F2 are both smaller than the pulse widths of the output enable signal OE1 and the gate clock signal CPV output in the first frame F1.

Figure 3B:
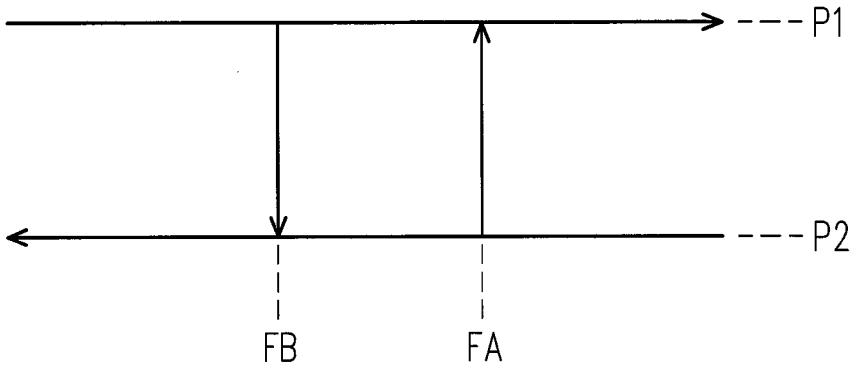
FIG. 3B is a schematic diagram of regulating the set of the LCD 100 according to an embodiment of the invention.

Moreover, a frame rate of the LCD 100 is varied along with different regions, and the difference of the frame rates may influence a charging time of the LCD panel 140, i.e. influence the pulse widths of the output enable signal OE and the gate clock signal CPV. FIG. 3B is a schematic diagram of regulating the set of the LCD 100 according to an embodiment of the invention. Referring to FIG. 3B, generally, the frame rate of the LCD 100 is approximately 50 Hz or 60 Hz. Therefore, the pulse widths of the output enable signal OE2 and the gate clock signal CPV output in the second frame F2 can be adjusted to different pulse widths according to different frame rates, and a first frame rate threshold FA and a second frame rate threshold FB can be set to determine the adjusted pulse widths of the output enable signal OE2 and the gate clock signal CPV. The first frame rate threshold FA is set to be greater than the second frame rate threshold FB, where the first frame rate threshold FA is, for example, 57 Hz, and the second frame rate threshold FB is, for example, 52 Hz. Moreover, the first frame rate threshold FA and the second frame rate threshold FB can be quite different to the frame rate to be determined, so as to avoid a boundary effect.

Further, when the frame rate of the LCD 100 is decreased to be smaller than the first frame rate threshold FA, the timing controller 110 sets the pulse width of the output enable signal OE2 and/or the gate clock signal CPV output in the second frame F2 to a larger pulse width (corresponding to a first pulse width P1). When the frame rate of the LCD 100 is increased to be greater than the second frame rate threshold FB, the timing controller 110 sets the pulse width of the output enable signal OE2 and/or the gate clock signal CPV output in the second frame F2 to a smaller pulse width (corresponding to a second pulse width P2).

Figure 3C:
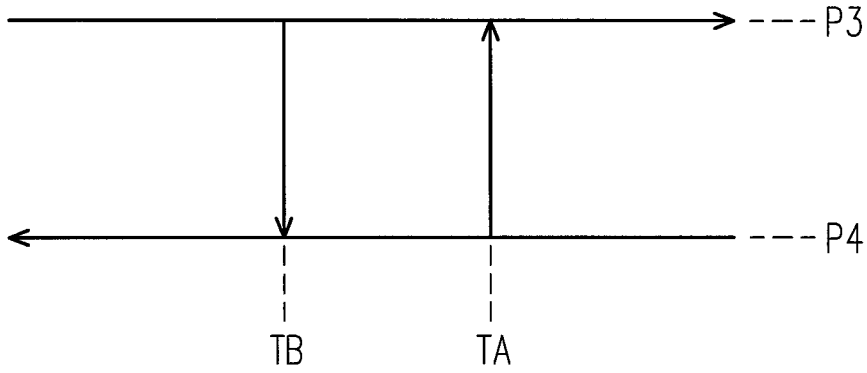
FIG. 3C is a schematic diagram of regulating the set of the LCD 100 according to another embodiment of the invention.

Moreover, when the LCD 100 initially operates, a working temperature thereof is increased from a lower working temperature to a higher working temperature along with time, and the difference of the working temperatures may influence a rotation speed of the liquid crystal of the LCD panel 140, i.e. influence a flicking degree caused by displaying of the second frame F2. FIG. 3C is a schematic diagram of regulating the set of the LCD 100 according to another embodiment of the invention. Referring to FIG. 3C, generally, the working temperature of the LCD 100 is increased from the lower working temperature of an initial operation state to the higher working temperature of a normal operation state. Therefore, the pulse width of the output enable signal OE2 and/or the gate clock signal CPV output in the second frame F2 is adjusted to different pulse widths according to the lower working temperature and the higher working temperature of the LCD 100, and a first temperature threshold TA and a second temperature threshold TB can be set to determine the pulse widths of the output enable signal OE2 and the gate clock signal CPV. The first temperature threshold TA and the second temperature threshold TB are between the aforementioned lower working temperature and the higher working temperature, and the first temperature threshold TA is greater than the second temperature threshold TB. Moreover, the first temperature threshold TA and the second temperature threshold TB can be quite different to the working temperature to be determined, so as to avoid the boundary effect.

Further, when the working temperature of the LCD 100 is decreased to be smaller than the first temperature threshold TA, the timing controller 110 sets the pulse width of the output enable signal OE2 and/or the gate clock signal CPV output in the second frame F2 to a larger pulse width (corresponding to a third pulse width P3). When the working temperature of the LCD 100 is increased to be greater than the second temperature threshold TB, the timing controller 110 sets the pulse width of the output enable signal OE2 and/or the gate clock signal CPV output in the second frame F2 to a smaller pulse width (corresponding to a fourth pulse width P4).

Moreover, in some embodiments, the LCD 100 can set the pulse widths of the output enable signal OE2 and the gate clock signal CPV output in the second frame F2 according to both of the frame rate and the working temperature.

Figure 4:
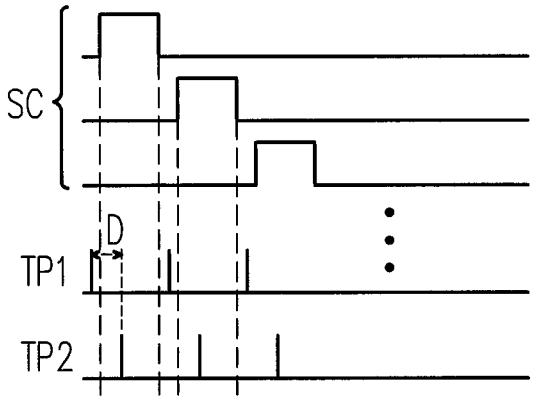
FIG. 4 is a timing schematic diagram of scan signals and latch signals of FIG. 1 according to an embodiment of the invention.

FIG. 4 is a timing schematic diagram of the scan signals and the latch signals of FIG. 1 according to an embodiment of the invention. Referring to FIG. 1 and FIG. 4, in the present embodiment, a latch signal TP 1 corresponds to the first frame F1, and a latch signal TP2 corresponds to the second frame F2. According to the above descriptions, when the timing controller 110 performs the polarity inversion on the polarity signal POL corresponding to the second frame F2, the timing controller 110 adjusts the output states of the scan signals SC or the pixel voltages VP to reduce the energy written into the LCD panel 140.

In the present embodiment, a second method of reducing the energy written into the LCD panel 140 is to delay the latch signal TP output to the source driver 130. Since the source driver 130 is controlled by the latch signal TP to receive the display data DD, a timing of the latch signal TP influences the output time of the pixel voltages VP. Namely, by delaying the latch signal TP output to the source driver 130, the output time of the pixel voltages VP can be shortened, so as to reduce the energy written into the LCD panel 140. In other words, when the timing controller 110 writes the second frame F2 into the LCD panel 140, it delays the latch signal TP by a delay time D for outputting, for example, the delay time D between the latch signals TP1 and TP2 shown in FIG. 4. The delay time D can be determined according to the frame brightness difference of the first frame F1 and the second frame F2, i.e. the greater the frame brightness difference is, the longer the delay time D is, and the smaller the frame brightness difference is, the shorter the delay time D is.

Moreover, since the difference of the frame rates influences the charging time of the LCD panel 140, the first frame rate threshold and the second frame rate threshold can be set to determine the delay time D of the latch signal TP2. Further, when the frame rate of the LCD 100 is decreased to be smaller than the first frame rate threshold, the timing controller 110 sets the delay time D of the latch signal TP2 output in the second frame F2 to a larger delay time (corresponding to a first delay time). When the frame rate of the LCD 100 is increased to be greater than the second frame rate threshold, the timing controller 110 sets the delay time D of the latch signal TP2 output in the second frame F2 to a smaller delay time (corresponding to a second delay time).

Moreover, since the difference of the working temperatures of the LCD 100 may influence the rotation speed of the liquid crystal of the LCD panel 140, the first temperature threshold and the second temperature threshold can be set to determine the delay time D of the latch signal TP2. Further, when the working temperature of the LCD 100 is decreased to be smaller than the first temperature threshold, the timing controller 110 sets the delay time D of the latch signal TP2 output in the second frame F2 to a smaller delay time (corresponding to a third delay time). When the working temperature of the LCD 100 is increased to be greater than the second frame rate threshold, the timing controller 110 sets the delay time D of the latch signal TP2 output in the second frame F2 to a larger delay time (corresponding to a fourth delay time).

Moreover, in some embodiments, the LCD 100 can set the delay time D of the latch signal TP2 output in the second frame F2 according to both of the frame rate and the working temperature.

Referring to FIG. 1, in the present embodiment, a third method of reducing the energy written into the LCD panel 140 is to reduce gray values corresponding to the pixel voltages VP output to the LCD panel 140. Since the pixel voltages VP determine brightness (i.e. the gray values) displayed by the pixels (not shown) of the LCD panel 140, the energy written into the LCD panel 140 can be reduced by reducing the gray values corresponding to the pixel voltages VP output to the LCD panel 140.

According to the above descriptions, when the timing controller 110 writes the second frame F2 into the LCD panel 140, the timing controller 110 can reduce the gray value corresponding to the display data DD. Namely, assuming an original gray value corresponding to the display data DD is 100, when the timing controller 110 writes the second frame F2 into the LCD panel 140, the timing controller 110 can reduce the gray value corresponding to the display data DD to 99. Alternatively, when the timing controller 110 writes the second frame F2 into the LCD panel 140, the timing controller 110 can reduce a voltage level of the gamma voltage VG corresponding to each of the gray values. Namely, assuming the gamma voltage VG corresponding to the gray value 100 is 8 volts, when the timing controller 110 writes the second frame F2, the timing controller 110 can reduce the gamma voltage VG corresponding to the gray value 100 to 7.9 volts. An adjustment amplitude of the gray value corresponding to the display data DD and an adjustment amplitude of the gamma voltage VG corresponding to each of the gray values are determined by the frame brightness difference of the first frame F1 and the second frame F2, i.e. the greater the frame brightness difference is, the greater the adjustment amplitude is, and the smaller the frame brightness difference is, the smaller the adjustment amplitude is.

Moreover, since the difference of the frame rates influences the charging time of the LCD panel 140, the first frame rate threshold and the second frame rate threshold can be set to determine the reduced gray value of the display data DD and the reduced voltage of the gamma voltage VG. Further, when the frame rate of the LCD 100 is decreased to be smaller than the first frame rate threshold, the timing controller 110 sets a higher reduced gray value (corresponding to a first gray value) of the display data DD corresponding to the second frame F2 or a higher reduced voltage of the gamma voltage VG, i.e. sets a higher reduced gray value (corresponding to the first gray value) of the pixel voltage VP. When the frame rate of the LCD 100 is increased to be greater than the second frame rate threshold, the timing controller 110 sets a lower reduced gray value of the display data DD corresponding to the second frame F2 or a lower reduced voltage of the gamma voltage VG, i.e. sets a lower reduced gray value (corresponding to a second gray value) of the pixel voltage VP.

Moreover, since the difference of the working temperatures of the LCD 100 may influence the rotation speed of the liquid crystal of the LCD panel 140, the first temperature threshold and the second temperature threshold can be set to determine the reduced gray value of the display data DD and the reduced voltage of the gamma voltage VG. Further, when the working temperature of the LCD 100 is decreased to be smaller than the first temperature threshold, the timing controller 110 sets a lower reduced gray value (corresponding to a third gray value) of the display data DD corresponding to the second frame F2 or a lower reduced voltage of the gamma voltage VG. When the working temperature of the LCD 100 is increased to be greater than the second frame rate threshold, the timing controller 110 sets a higher reduced gray value (corresponding to a fourth gray value) of the display data DD corresponding to the second frame F2 or a higher reduced voltage of the gamma voltage VG.

Moreover, in some embodiments, the LCD 100 can set the reduced gray value of the display data DD corresponding to the second frame F2 or the reduced voltage of the gamma voltage VG according to both of the frame rate and the working temperature.

Figure 5:
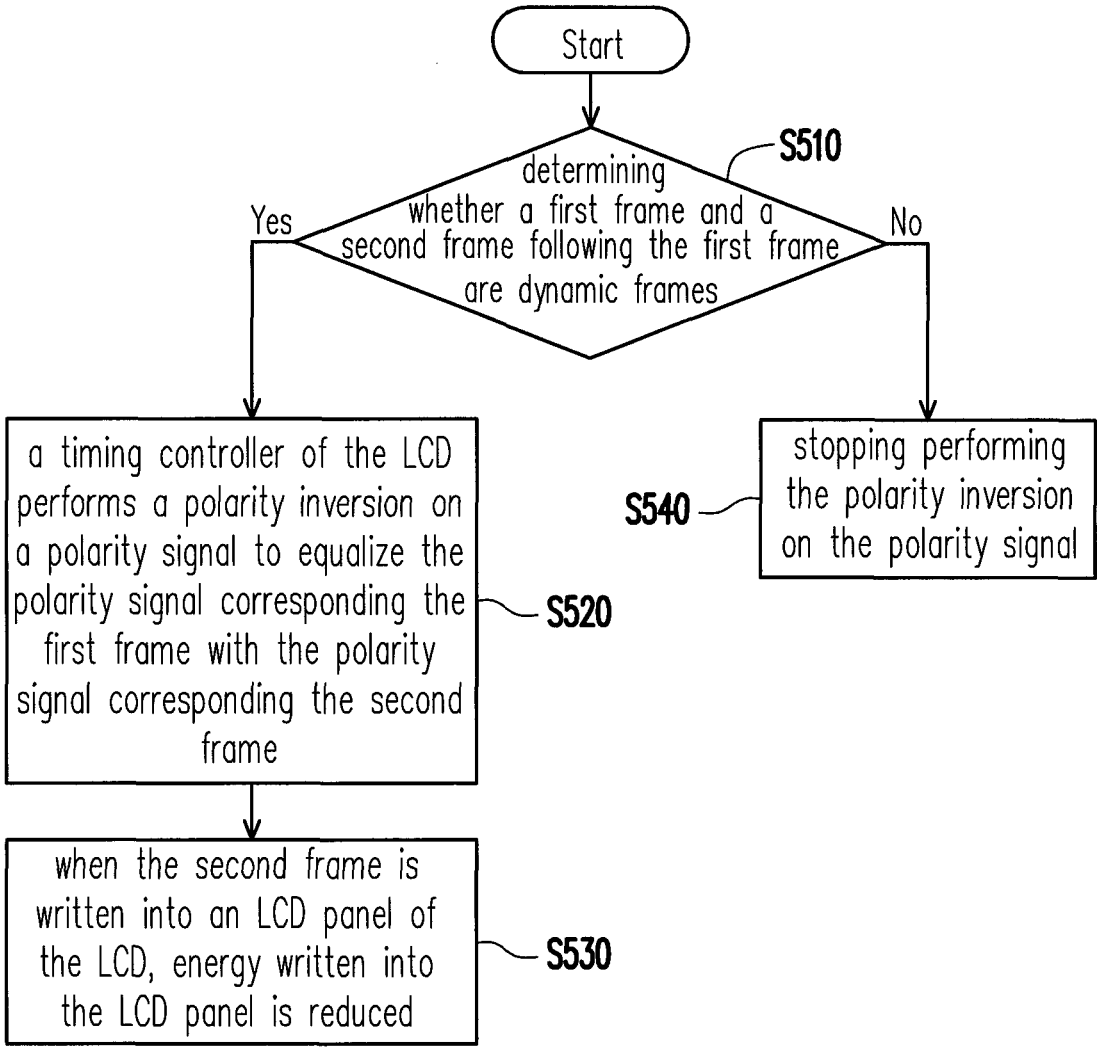
FIG. 5 is a flowchart illustrating a method for operating an LCD according to an embodiment of the invention.

FIG. 5 is a flowchart illustrating a method for operating an LCD according to an embodiment of the invention. Referring to FIG. 5, in the present embodiment, the method for operating the LCD includes following steps. It is determined whether a first frame and a second frame following the first frame are dynamic frames (step S510). When the first frame and the second frame are the dynamic frames, i.e. when a determination result of the step S510 is "yes", a timing controller of the LCD performs a polarity inversion on a polarity signal to equalize the polarity signal corresponding to the first frame with the polarity signal corresponding to the second frame (step S520). When the second frame is written into an LCD panel of the LCD, energy written into the LCD panel is reduced (step S530). When one of the first frame and the second frame is a static frame, i.e. when the determination result of the step S510 is "no", it is stopped performing the polarity inversion on the polarity signal. Details of the above steps can refer to related descriptions of the embodiments of FIG. 1-FIG. 4, which are not repeated.

In summary, in the LCD and the method for operating the same, when the first frame and the second frame are all dynamic frames, the timing controller performs the polarity inversion on the polarity signal to equalize the polarity signal corresponding to the first frame with the polarity signal corresponding to the second frame, so as to reduce a chance of liquid crystal polarization of the LCD panel. Now, the timing controller controls the source driver and/or the gate driver to reduce the energy written into the LCD panel, so as so avoid a frame flicking phenomenon occurred when the LCD panel displays the brighter second frame.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A method for operating a liquid crystal display, comprising:

determining whether a first frame and a second frame following the first frame are dynamic frames;

when the first frame and the second frame are the dynamic frames, a timing controller of the liquid crystal display performing a polarity inversion on a polarity signal based on a determination result, to equalize the polarity signal corresponding to the first frame with the polarity signal corresponding to the second frame; and reducing energy written into a liquid crystal display panel when the second frame is written into the liquid crystal display panel of the liquid crystal display.

2. The method for operating the liquid crystal display as claimed in claim 1, wherein the step of reducing the energy written into the liquid crystal display panel comprising:

shortening a pulse width of an output enable signal or a gate clock signal to shorten pulse widths of a plurality of scan signals output to the liquid crystal display panel.

3. The method for operating the liquid crystal display as claimed in claim 2, further comprising:

setting the pulse width of the output enable signal or the gate clock signal to a first pulse width when a frame rate of the liquid crystal display is decreased to be smaller than a first frame rate threshold; and setting the pulse width of the output enable signal or the gate clock signal to a second pulse width when the frame rate of the liquid crystal display is increased to be greater than a second frame rate threshold, wherein the first frame rate threshold is greater than the second frame rate threshold, and the first pulse width is greater than the second pulse width.

4. The method for operating the liquid crystal display as claimed in claim 2, further comprising:

setting the pulse width of the output enable signal or the gate clock signal to a third pulse width when a working temperature of the liquid crystal display is decreased to be smaller than a first temperature threshold; and setting the pulse width of the output enable signal or the gate clock signal to a fourth pulse width when the working temperature of the liquid crystal display is increased to be greater than a second temperature threshold, wherein the first temperature threshold is greater than the second temperature threshold, and the third pulse width is greater than the fourth pulse width.

5. The method for operating the liquid crystal display as claimed in claim 1, wherein the step of reducing the energy written into the liquid crystal display panel comprises:

delaying a latch signal to shorten output time of a plurality of pixel voltages output to the liquid crystal display panel.

6. The method for operating the liquid crystal display as claimed in claim 5, further comprising:

setting a delay time of the latch signal to a first delay time when a frame rate of the liquid crystal display is decreased to be smaller than a first frame rate threshold; and setting the delay time of the latch signal to a second delay time when the frame rate of the liquid crystal display is increased to be greater than a second frame rate threshold, wherein the first frame rate threshold is greater than the second frame rate threshold, and the first delay time is greater than the second delay time.

7. The method for operating the liquid crystal display as claimed in claim 5, further comprising:

setting a delay time of the latch signal to a third delay time when a working temperature of the liquid crystal display is decreased to be smaller than a first temperature threshold; and setting the delay time of the latch signal to a fourth delay time when the working temperature of the liquid crystal display is increased to be greater than a second temperature threshold, wherein the first temperature threshold is greater than the second temperature threshold, and the third delay time is smaller than the fourth delay time.

8. The method for operating the liquid crystal display as claimed in claim 1, wherein the step of reducing the energy written into the liquid crystal display panel comprises:

reducing gray values corresponding to a plurality of pixel voltages output to the liquid crystal display panel.

9. The method for operating the liquid crystal display as claimed in claim 8, further comprising:

decreasing the gray values corresponding to the pixel voltages by a first gray value when a frame rate of the liquid crystal display is decreased to be smaller than a first frame rate threshold; and decreasing the gray values corresponding to the pixel voltages by a second gray value when the frame rate of the liquid crystal display is increased to be greater than a second frame rate threshold, wherein the first frame rate threshold is greater than the second frame rate threshold, and the first gray value is greater than the second gray value.

10. The method for operating the liquid crystal display as claimed in claim 8, further comprising:

decreasing the gray values corresponding to the pixel voltages by a third gray value when a working temperature of the liquid crystal display is decreased to be smaller than a first temperature threshold; and decreasing the gray values corresponding to the pixel voltages by a fourth gray value when the working temperature of the liquid crystal display is increased to be greater than a second temperature threshold, wherein the first temperature threshold is greater than the second temperature threshold, and the third gray value is smaller than the fourth gray value.

11. The method for operating the liquid crystal display as claimed in claim 1, further comprising:

stopping performing the polarity inversion on the polarity signal when one of the first frame and the second frame is a static frame.

12. The method for operating the liquid crystal display as claimed in claim 1, wherein the step of determining whether the first frame is the dynamic frame comprises:

determining the first frame to be the dynamic frame when the first frame and a plurality of consecutive previous frames are different, wherein the first frame follows the previous frames; and determining the first frame to be a static frame when the two neighbouring frames of first frame and the previous frames are the same.

13. A liquid crystal display, comprising:

a liquid crystal display panel;

a gate driver, coupled to the liquid crystal display panel, and outputting a plurality of scan signals to the liquid crystal display panel;

a source driver, coupled to the liquid crystal display panel, and outputting a plurality of pixel voltages to the liquid crystal display panel; and a timing controller, coupled to the gate driver and the source driver, receiving a first frame and a second frame following the first frame, and determining whether the first frame and the second frame are dynamic frames, wherein when the first frame and the second frame are dynamic frames, the timing controller performs a polarity inversion on a polarity signal output to the source driver based on a determination result, to equalize the polarity signal corresponding to the first frame with the polarity signal corresponding to the second frame, and when the second frame is written into the liquid crystal display panel, the timing controller adjusts output states of the scan signals or the pixel voltages to reduce energy written into the liquid crystal display panel.

14. The liquid crystal display as claimed in claim 13, wherein the timing controller shortens a pulse width of an output enable signal or a gate clock signal output to the gate driver to shorten pulse widths of the scan signals output to the liquid crystal display panel.

15. The liquid crystal display as claimed in claim 14, wherein when a frame rate of the liquid crystal display is decreased to be smaller than a first frame rate threshold, the timing controller sets the pulse width of the output enable signal or the gate clock signal to a first pulse width, and when the frame rate of the liquid crystal display is increased to be greater than a second frame rate threshold, the timing controller sets the pulse width of the output enable signal or the gate clock signal to a second pulse width, wherein the first frame rate threshold is greater than the second frame rate threshold, and the first pulse width is greater than the second pulse width.

16. The liquid crystal display as claimed in claim 14, wherein when a working temperature of the liquid crystal display is decreased to be smaller than a first temperature threshold, the timing controller sets the pulse width of the output enable signal or the gate clock signal to a third pulse width, and when the working temperature of the liquid crystal display is increased to be greater than a second temperature threshold, the timing controller sets the pulse width of the output enable signal or the gate clock signal to a fourth pulse width, wherein the first temperature threshold is greater than the second temperature threshold, and the third pulse width is greater than the fourth pulse width.

17. The liquid crystal display as claimed in claim 13, wherein the timing controller delays a latch signal output to the source driver to shorten output time of the pixel voltages output to the liquid crystal display panel.

18. The liquid crystal display as claimed in claim 17, wherein when a frame rate of the liquid crystal display is decreased to be smaller than a first frame rate threshold, the timing controller sets a delay time of the latch signal to a first delay time, and when the frame rate of the liquid crystal display is increased to be greater than a second frame rate threshold, the timing controller sets the delay time of the latch signal to a second delay time, wherein the first frame rate threshold is greater than the second frame rate threshold, and the first delay time is greater than the second delay time.

19. The liquid crystal display as claimed in claim 17, wherein when a working temperature of the liquid crystal display is decreased to be smaller than a first temperature threshold, the timing controller sets a delay time of the latch signal to a third delay time, and when the working temperature of the liquid crystal display is increased to be greater than a second temperature threshold, the timing controller sets the delay time of the latch signal to a fourth delay time, wherein the first temperature threshold is greater than the second temperature threshold, and the third delay time is smaller than the fourth delay time.

20. The liquid crystal display as claimed in claim 13, wherein the timing controller controls the source driver to reduce gray values corresponding to a plurality of pixel voltages output to the liquid crystal display panel.

21. The liquid crystal display as claimed in claim 20, wherein when a frame rate of the liquid crystal display is decreased to be smaller than a first frame rate threshold, the timing controller controls the source driver to decrease the gray values corresponding to the pixel voltages by a first gray value, and when the frame rate of the liquid crystal display is increased to be greater than a second frame rate threshold, the timing controller controls the source driver to decrease the gray values corresponding to the pixel voltages by a second gray value, wherein the first frame rate threshold is greater than the second frame rate threshold, and the first gray value is greater than the second gray value.

22. The liquid crystal display as claimed in claim 20, wherein when a working temperature of the liquid crystal display is decreased to be smaller than a first temperature threshold, the timing controller controls the source driver to decrease the gray values corresponding to the pixel voltages by a third gray value, and when the working temperature of the liquid crystal display is increased to be greater than a second temperature threshold, the timing controller controls the source driver to decrease the gray values corresponding to the pixel voltages by a fourth gray value, wherein the first temperature threshold is greater than the second temperature threshold, and the third gray value is smaller than the fourth gray value.

23. The liquid crystal display as claimed in claim 13, wherein when one of the first frame and the second frame is a static frame, the timing controller stops performing the polarity inversion on the polarity signal.

24. The liquid crystal display as claimed in claim 13, wherein when the first frame and a plurality of consecutive previous frames are different, the timing controller determines the first frame to be the dynamic frame, and when two neighbouring frames of the first frame and the previous frames are the same, the timing controller determines the first frame to be a static frame, wherein the first frame follows the previous frames.

* * * * *